US005344342A

United States Patent [19]

Briones

[11] Patent Number: 5,344,342

[45] Date of Patent: Sep. 6, 1994

[54] FILTERED VGA CONNECTOR

[75] Inventor: Francisco R. Briones, Markham, Canada

[73] Assignee: Amphenol Corporation, Wallingford, Conn.

[21] Appl. No.: 1,662

[22] Filed: Jan. 7, 1993

[51] Int. Cl.[5] ..... H01R 13/66

[52] U.S. Cl. ..... 439/620; 439/108

[58] Field of Search ..... 439/95, 607, 620, 108

[56] References Cited

U.S. PATENT DOCUMENTS

| | | | |
|---|---|---|---|
| 4,690,479 | 9/1987 | Hollyday et al. | 439/620 X |
| 4,695,105 | 9/1987 | Ney | 439/620 X |
| 4,695,115 | 9/1987 | Talend | 439/76 |
| 4,729,743 | 3/1988 | Farrar et al. | 439/276 |
| 4,772,224 | 9/1988 | Talend | 439/607 |
| 4,799,901 | 1/1989 | Pirc | 439/620 |
| 4,804,332 | 2/1989 | Pirc | 439/620 |
| 4,808,125 | 2/1989 | Waters et al. | 439/607 |
| 4,842,529 | 6/1989 | Frantz et al. | 439/95 |
| 4,884,982 | 12/1989 | Fleming et al. | 439/620 |
| 4,929,196 | 6/1990 | Ponn et al. | 439/620 |
| 4,934,960 | 6/1990 | Capp et al. | 439/620 |
| 5,032,091 | 7/1991 | Itzkoff | 439/620 |
| 5,057,041 | 10/1991 | Yu et al. | 439/620 |
| 5,062,811 | 11/1991 | Hackman | 439/620 |
| 5,087,212 | 2/1992 | Hanami | 439/620 |
| 5,094,628 | 3/1992 | Kano | 439/620 |
| 5,102,354 | 4/1992 | Crane et al. | 439/620 |
| 5,108,300 | 4/1992 | Weber | 439/188 |

*Primary Examiner*—Eugene F. Desmond
*Attorney, Agent, or Firm*—Bacon & Thomas

[57] ABSTRACT

A VGA filter connector includes a plurality of capacitor chips electrically connected between signal contacts and a grounding spring located in the connector. One of the connector contacts is a ground contact, and the grounding spring includes a ground tail electrically connected to the ground contact in order to provide a path for transients which extends from the signal contacts to the ground contact via the capacitor chips.

12 Claims, 1 Drawing Sheet

FILTERED VGA CONNECTOR

BACKGROUND OF THE INVENTION

1. Field of the Invention

This invention relates to a capacitively filtered Virtual Graphics Adapter (VGA) connector. More generally, the invention relates to an arrangement for mounting electrical components between electrical contacts in an electrical connector.

2. Description of the Related Art

A practical arrangement for utilizing chip capacitors in multiple-pin electrical connectors, in order to provide a ground path for high frequency transients present in the electrical signal contacts of the connector, was first proposed in the U.S.Pat. No. 4,500,159 (Briones). Previous capacitive filtering arrangements had required relatively expensive monolithic capacitor filters or individual filter sleeves for each contact. In contrast, the Briones connector utilized a completely different structure, starting with an insert having a plurality of contact passages and a plurality of recesses in communication with the contact passages, the recesses permitting individual chip capacitors to be inserted such that one electrode on each capacitor electrically contacts one of the signal contacts. Connection to ground in the Briones connector was provided by a ground member or clip which also served to resiliently bias the chip capacitors against the contacts, thus avoiding the need for soldering of the filters to the contacts, a finger on the clip engaging the second electrode on each of the capacitors. A second embodiment described in the Briones patent varied this arrangement by providing the biasing spring on the contacts themselves.

The basic Briones design has since been adapted for a variety of purposes other than the original multi-pin filter connector specifically disclosed in the Briones patent. For example, chip capacitors biased by a grounding clip against a conductive shell have been used for the purpose of capacitive decoupling in coaxial BNC and TNC connectors, and the Briones design has also been adapted for use in telephone jacks. A capacitively decoupled coaxial connector was disclosed, for example, in U.S. Pat. No. 4,772,221 (Kozloff), and subsequently in U.S. Pat. No. 4,884,982 (Fleming). These designs were in turn based, at least in part, on design concepts proposed in the Briones patent and subsequently developed in a line of BNC and TNC connectors offered by Amphenol Corp. In the field of telephone-type jacks, the basic Briones arrangement was modified by using tombstone chip capacitors, in which one electrode of the capacitor chip is soldered to the signal contacts as disclosed, for example, in U.S. Pat. Nos. 4,695,115 (Talend) and 4,772,224 (Talend).

All of the designs described above share a significant limitation. They are each adapted to electrically connect the chip capacitor directly between an external ground and the contacts of the connector (or a single contact in the case of a coaxial connector). Use of the basic Briones design in situations where external grounding, to the shell of the connector or directly to an external panel or device, is undesirable or impractical has heretofore not been considered.

The present invention provides a solution to this problem by modifying the original Briones concept to enable the ground clip to provide an electrical connection to a ground contact in the connector, rather than to the shell. While the invention is described specifically in the context of VGA connectors, for which it is especially suitable, it may of course be used in any connector having two or more electrical contacts, at least one of which needs to be connected to another via an electrical component.

SUMMARY OF THE INVENTION

It is accordingly a first objective of the invention to provide an electrical connector in which one contact is connected to another contact via an electrical component, and in particular to provide an electrical connector in which one contact is electrically connected to another contact via a chip capacitor.

It is a second objective of the invention to provide an electrical connector in which one contact is electrically connected to another contact via a removable electrical component having electrodes at each end, and in particular an electrical connector in which one contact is connected to another contact via a removable chip capacitor, the capacitor being retained in the connector and electrically connected to the contacts without soldering.

It is a third objective of the invention to provide an electrical connector of the type having at least two electrical contacts, one of which is a ground contact, and in which one other of the at least two electrical contacts is electrically connected to the ground contact via a chip capacitor.

It is a fourth objective of the invention to provide an electrical connector of the type having at least two electrical contacts, one of which is a ground contact, and in which one other of the at least two electrical contacts is a signal contact electrically connected to the ground contact via a filtering capacitor.

It is a fifth objective of the invention to provide a VGA connector in which at least one of the signal contacts is filtered.

It is a sixth objective of the invention to provide a VGA connector in which the signal contacts are connected by individual filter capacitors to at least one ground contact in the connector.

These and other objectives of the invention are accomplished by, for example, providing a VGA connector having a plurality of signal contacts and at least one ground contact electrically connected to the signal contacts via individual chip capacitors, the chip capacitors being positioned in recesses which communicate with passages of a dielectric connector body through which the contacts pass, the chip capacitors resting on the contacts and being biased thereagainst by a ground clip. In an especially advantageous embodiment of the invention, the ground clip includes an integral ground tail which is directly connected to the ground contact.

DETAILED DESCRIPTION OF THE PREFERRED EMBODIMENTS

Figure 2:
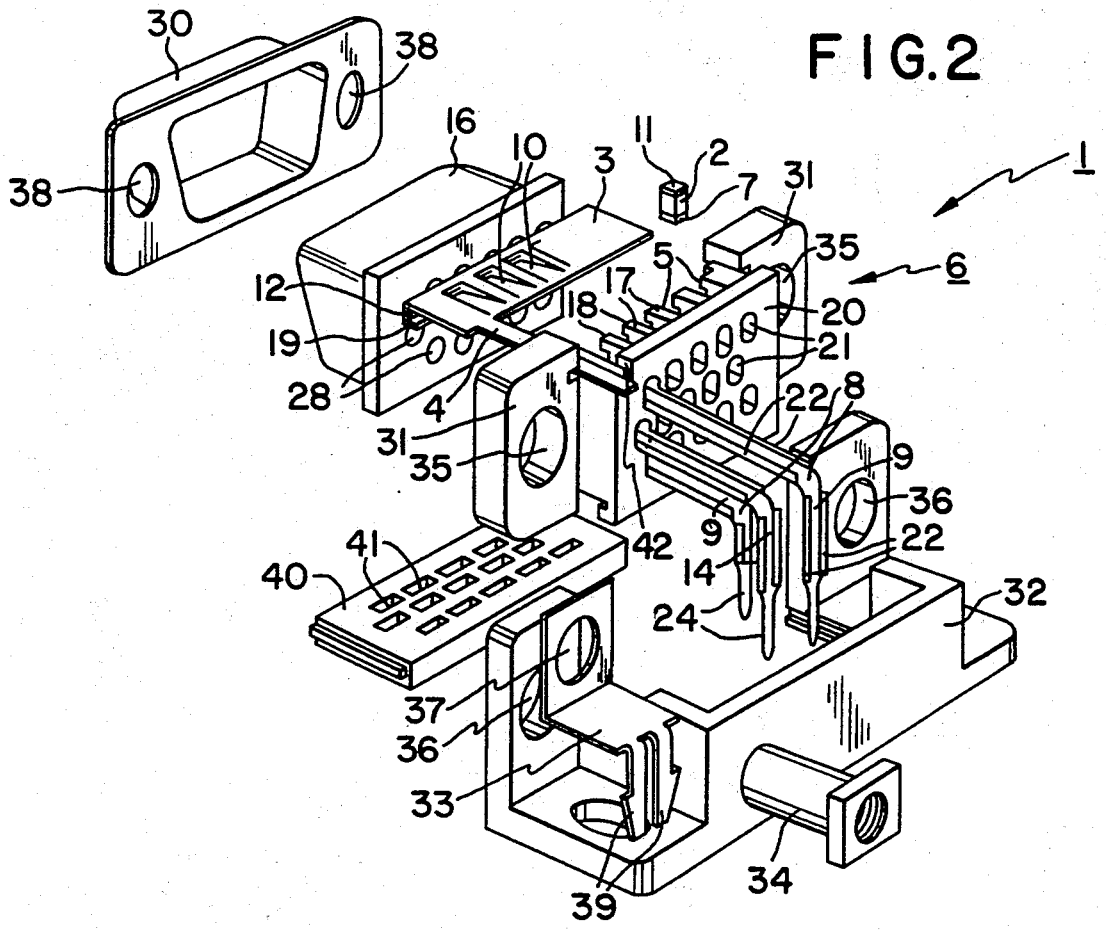
FIG. 2 is an exploded perspective view of the preferred VGA filter connector of FIG. 1.
Figure 1:
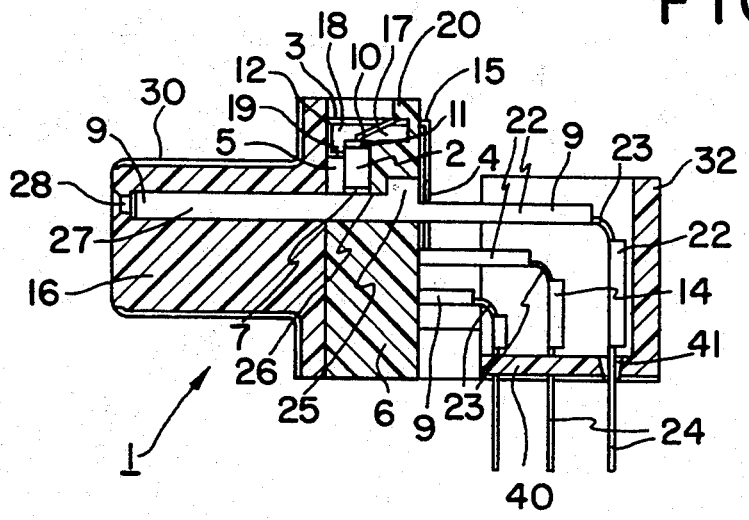
FIG. 1 is a cross-sectional side view of a preferred VGA filter connector embodying the principles of the invention.

FIGS. 1 and 2 show a VGA filter connector 1 which includes a chip capacitor 2, grounding spring 3, and ground tail 4 arranged in accordance with the principles of the invention. The remaining elements of the illustrated VGA connector are essentially conventional, except as modified to accommodate elements 2–4, and it is to be understood that the inventive capacitor chip/-grounding spring/ground tail arrangement is therefore not to be limited to the illustrated connector, but rather that it may be used in a variety of different connectors, the only requirements being that the device in which the arrangement is used have at least two electrical contacts, one of which can be connected to the other.

Furthermore, the invention should not be limited to chip capacitors, but rather may be applied to a variety of other similarly structured electrical components, so long as the component has electrodes at opposite ends. Examples of such components which may be in chip form include diodes, varistors, spark gaps, fuses, and combinations of those elements with each other and with capacitors.

In the preferred arrangement, a chip capacitor 2 (only one of which is shown) is positioned in one of a plurality of slots or grooves 5 of a dielectric connector body 6. One electrode 7 of each capacitor rests on a flat portion 8 of signal contacts 9. Capacitors 2 are biased against the signal contacts 9 by fingers 10 of grounding spring 3. Fingers 10 engaged electrodes 11 to thereby form an electrical connection with grounding spring 3. Grounding spring 3 includes a main body 12, a downwardly extending portion 13 on a front side of the main body, and the ground tail 4 which is integral with main body 21 and extends rearwardly and downwardly from main body 12 to engage ground contact 14. The electrical connection may be completed by soldering.

A transition portion 15 between the horizontal and vertical portions of ground tail 4 is located close to main body 12, with the horizontal portion being preferably just long enough to clear dielectric body 6. However, in FIG. 2 ground tail 4 is illustrated as being completely horizontally extending. This is the position of the ground tail before it is bent downward to engage a ground circuit, as shown in FIG. 1.

Each slot 5 is enclosed on three sides and on the bottom. The open side faces a front portion 16 of the connector and the top of each slot is open. A plurality of partitions 17 between the slots are provided with overhangs 18, around which downwardly extending portion 12, including an inwardly facing edge 19, is wrapped to both support the clip and retain the capacitors in the slots, while permitting them to be removed when the clip is removed from body 6. The rear wall 20 of the connector body 6 includes a plurality of contact passages 21 positioned so that the signal contacts 9 and ground contact 14 extend through the passages 21. The signal contacts 9 are supported by the base of the slots and each of the contacts 9 and 14 includes bights extend along the sides of the contacts except in the area of 90° bends 23 provided between horizontal and vertical portions of the contacts. Each of contact includes circuit board engaging portions 24 which are inserted into corresponding holes in a circuit board (not shown). Bights 22 include raised portions 25 which fit within passages 20 to position the contacts therein by engagement with a step portion 26 provided at the front of the passages. A forward length 27 of each bight 22 is also raised to accommodate insertion of pins on a male VGA connector (not shown), portions 27 fitting within passages 28 of front portion 16 of connector 1.

The remaining elements of the illustrated VGA connector, all of which are conventional, include a shield member 30, flanges 31 on body 6, a rear body 32, and a clip 33. A threaded grommet 34 fits through holes 35-37 to permit a mating connector to be secured to connector 1 through openings 38 in shield 30. Connector 1 is fastened to the circuit board by hooks 39 which also serve to ground the shield and the mating connector. Generally, both the mating connector and shield will be located outside the electrical device in which the connector and circuit board are located, while the dielectric body is located inside the device and need not be shielded. A base 40 of the connector includes passages 41 for the downwardly extending portions of the contacts.

Although ground tail 4 is preferably integral with the main body 12 of the ground clip 2, extending rearwardly through a notch 42 provided in the dielectric connector body 6, and then downwardly to complete a path between the ground clip and the ground contact, thereby electrically connecting each of the signal contacts on which a capacitor 2 has been placed to the ground contact via the capacitors, it will be appreciated by those skilled in the art that ground tail 4 could be replaced by a discrete conductive member extending between clip 2 and ground contact 14.

It will further be appreciated by those skilled in the art that numerous other variations and modifications of the invention are possible, all of which are intended to included within the scope of the invention. Consequently, the invention is not to be limited in any way by the above description, but rather it is to be defined solely by the appended claims.

What is claimed is:

1. An electrical connector, comprising:

at least two electrical contacts;

an electrically conductive member; and an electrical component electrically connected between the conductive member and a first of the two electrical contacts, wherein said conductive member includes a tail electrically connected to a second of the two electrical contacts, and wherein each of said two electrical contacts is adapted at one end to mate with corresponding contacts on a complementary connector and adapted at a second end to engage a grounding member in an electrical device, said tail being electrically connected to the second contact at a point between said two ends.

2. A connector as claimed in claim 1, wherein said component is a chip capacitor.

3. A connector as claimed in claim 2, wherein one electrode of said capacitor engages said first contact and a second electrode of said capacitor engages said conductive member.

4. A connector as claimed in claim 3, wherein said conductive member comprising means including resilient fingers extending therefrom which engage the second electrode to bias the capacitor against said first contact.

5. A connector as claimed in claim 3, further comprising a plurality of additional contacts, and a capacitor connected between each of said additional contacts and said conductive member.

6. A connector as claimed in claim 1, wherein said connector is a VGA connector.

7. A connector as claimed in claim 6, wherein said VGA connector comprises a dielectric body having a plurality of passages, the contacts extending through said passages, and a plurality of slots in which said capacitors are positioned.

8. A connector as claimed in claim 7, wherein said slots have a top, a bottom, and four sides, wherein said slots are closed on three sides and open on one side and on the top, and wherein said grounding spring engages said capacitors from the top and the conductive member further includes an extension extends downwardly along the open sides of the slots to retain the capacitors in the slots.

9. A connector as claimed in claim 7, wherein said ground tail extends through a notch in said dielectric body and includes a downwardly extending section, which extends from a 90° bend in said ground tail to engage the ground contact.

10. A connector as claimed in claim 1, wherein said tail is soldered to said second contact.

11. A connector as claimed in claim 1, wherein said first contact is a signal contact and said second contact is a ground contact.

12. A connector as claimed in claim I 1, wherein said component is a chip capacitor.

* * * * *